US012247573B2

(12) United States Patent
Yonemura et al.

(10) Patent No.: US 12,247,573 B2
(45) Date of Patent: Mar. 11, 2025

(54) CENTRIFUGAL COMPRESSOR AND TURBOCHARGER

(71) Applicant: IHI Corporation, Tokyo (JP)

(72) Inventors: Atsushi Yonemura, Tokyo (JP); Ryota Sakisaka, Tokyo (JP); Yoichi Sato, Tokyo (JP); Ryosuke Inomata, Tokyo (JP); Taiki Kanzawa, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 18/363,894

(22) Filed: Aug. 2, 2023

(65) Prior Publication Data

US 2023/0375004 A1 Nov. 23, 2023

Related U.S. Application Data

(63) Continuation of application No. PCT/JP2022/006328, filed on Feb. 17, 2022.

(30) Foreign Application Priority Data

Jun. 9, 2021 (JP) ..... 2021-096936

(51) Int. Cl.
*F04D 27/02* (2006.01)
*F04D 17/10* (2006.01)
(Continued)

(52) U.S. Cl.
CPC ..... *F04D 27/0253* (2013.01); *F04D 17/10* (2013.01); *F04D 29/284* (2013.01); *F04D 29/441* (2013.01)

(58) Field of Classification Search
CPC ..... F04D 27/0253; F05D 2250/294
See application file for complete search history.

(56) References Cited

U.S. PATENT DOCUMENTS 4,122,668 A * 10/1978 Chou ..... F01D 21/006 188/290
10,393,009 B2 * 8/2019 Mohtar ..... F04D 29/464
(Continued)

FOREIGN PATENT DOCUMENTS

DE 102018006963 A1 * 3/2020 ..... F02C 9/20
JP 2018-59482 A 4/2018
JP 2019-536939 A 12/2019

OTHER PUBLICATIONS

International Search Report issued Apr. 26, 2022 in PCT/JP2022/006328 filed on Feb. 17, 2022, 2 pages.

*Primary Examiner* — Brian P Wolcott
*Assistant Examiner* — John S Hunter, Jr.
(74) *Attorney, Agent, or Firm* — Oblon, McClelland, Maier & Neustadt, L.L.P.

(57) ABSTRACT

A centrifugal compressor includes: a housing including an intake flow path; a compressor impeller arranged in the intake flow path and including a plurality of blades; an accommodation chamber formed upstream of the blades in a flow of intake air in the housing; a movable member arranged in the accommodation chamber and movable to a protruding position where the movable member protrudes into the intake flow path and to a retracted position where the movable member is retracted from the intake flow path; and one or more grooves formed over an inner circumferential surface and a side face closer to the blades in the movable member.

13 Claims, 12 Drawing Sheets

(51) Int. Cl.
*F04D 29/28* (2006.01)
*F04D 29/44* (2006.01)

(56) References Cited

U.S. PATENT DOCUMENTS

| | | | | |
|---|---|---|---|---|
| 10,544,808 | B2 * | 1/2020 | Mohtar | F16K 3/03 |
| 10,900,497 | B2 * | 1/2021 | Bogner | F04D 29/4213 |
| 11,460,047 | B2 * | 10/2022 | Sakisaka | F04D 17/10 |
| 2019/0264710 | A1 | 8/2019 | Mohtar et al. | |
| 2020/0011196 | A1 | 1/2020 | Karstadt et al. | |
| 2021/0088054 | A1 * | 3/2021 | Sakisaka | F02B 33/40 |

* cited by examiner

CENTRIFUGAL COMPRESSOR AND TURBOCHARGER

CROSS REFERENCE TO RELATED APPLICATIONS

This application is a continuation application of International Application No. PCT/JP2022/006328, filed on Feb. 17, 2022, which claims priority to Japanese Patent Application No. 2021-096936 filed on Jun. 9, 2021, the entire contents of which are incorporated herein by reference.

BACKGROUND ART

Technical Field

The present disclosure relates to a centrifugal compressor and a turbocharger.

A centrifugal compressor includes a compressor housing in which an intake flow path is formed. A compressor impeller is arranged in the intake flow path. When an air flow rate into the compressor impeller decreases, air compressed by the compressor impeller flows backward in the intake flow path, a phenomenon known as surging.

Patent Literature 1 discloses a centrifugal compressor comprising a throttling mechanism in a compressor housing. The throttling mechanism includes a movable member. The movable member is configured to be movable to a protruding position where the movable member protrudes into an intake flow path and to a retracted position where the movable member is retracted from the intake flow path. The throttling mechanism reduces a cross-sectional area of the intake flow path by causing the movable member to protrude into the intake flow path. When the movable member protrudes into the intake flow path, air flowing backward in the intake flow path is blocked by the movable member. By blocking the air flowing backward in the intake flow path, surging is curbed.

CITATION LIST

Patent Literature

Patent Literature 1: US 2019/0264710 A1

SUMMARY

Technical Problem

The air flowing backward in the intake flow path includes a swirl component caused by the rotation of the compressor impeller. When the air flowing backward in the intake flow path is blocked by the movable member as described in Patent Literature 1, the swirl component of the air flowing backward disturbs a flow near a leading edge of the compressor impeller, which may generate noise that may be considered as aerodynamic noise.

The purpose of the present disclosure is to provide a centrifugal compressor and a turbocharger that can reduce noise.

Solution to Problem

In order to solve the above problem, a centrifugal compressor according to one aspect of the present disclosure includes: a housing including an intake flow path; a compressor impeller arranged in the intake flow path and including a plurality of blades; an accommodation chamber formed upstream of the blades in a flow of intake air in the housing; a movable member arranged in the accommodation chamber and movable to a protruding position where the movable member protrudes into the intake flow path and to a retracted position where the movable member is retracted from the intake flow path; and one or more grooves formed over an inner circumferential surface and a side face closer to the blades in the movable member.

The groove may include a plurality of spherical grooves arranged in a circumferential direction of the compressor impeller.

The groove may include a plurality of arc-shaped circumferential grooves arranged in a circumferential direction of the compressor impeller.

The plurality of grooves may be formed spaced apart from each other in the circumferential direction.

The plurality of grooves may be formed at unequal intervals in the circumferential direction.

In order to solve the above problem, a turbocharger of the present disclosure includes the centrifugal compressor described above.

Effects of Disclosure

According to the present disclosure, noise can be reduced.

DESCRIPTION OF EMBODIMENTS

Embodiments of the present disclosure will be described in detail below with reference to the accompanying drawings. Specific dimensions, materials, and numerical values described in the embodiments are merely examples for a better understanding, and do not limit the present disclosure unless otherwise specified. In this specification and the drawings, duplicate explanations are omitted for elements having substantially the same functions and configurations by assigning the same reference sign. Furthermore, elements not directly related to the present disclosure are omitted from the figures.

First Embodiment

Figure 1:
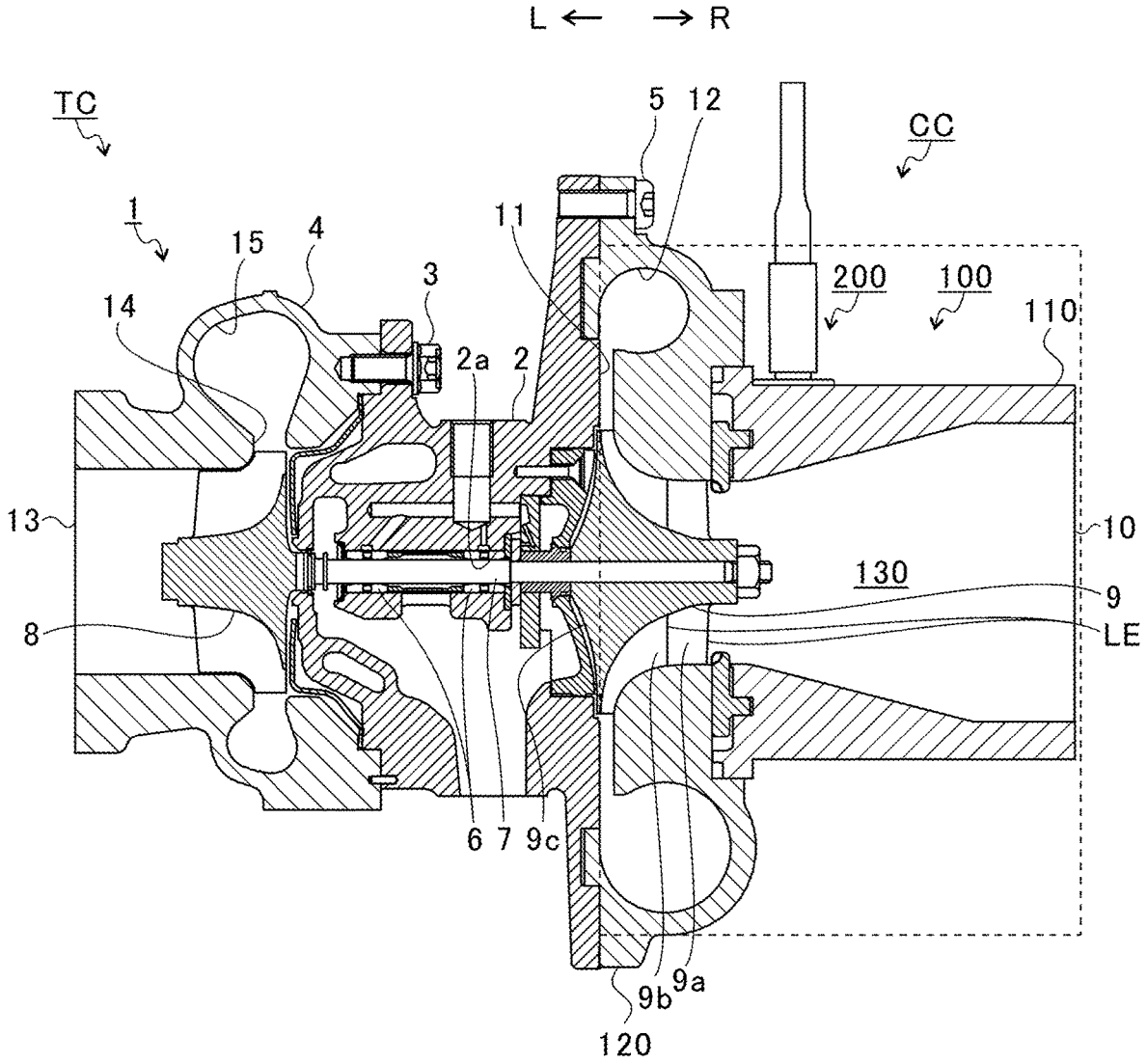
FIG. 1 is a schematic cross-sectional view of a turbocharger according to the first embodiment.

FIG. 1 is a schematic cross-sectional view of a turbocharger TC according to the first embodiment. A direction indicated by arrow L in FIG. 1 is described as the left side of the turbocharger TC. A direction indicated by arrow R shown in FIG. 1 is described as the right side of the turbocharger TC. In the turbocharger TC, a part including a compressor housing 100 (described later) functions as a centrifugal compressor CC. Hereinafter, the centrifugal compressor CC is described as being driven by a turbine impeller 8 (described later). However, the centrifugal compressor CC is not limited thereto, and may be driven by an engine (not shown) or by an electric motor (motor, not shown). As such, the centrifugal compressor CC may be incorporated into a device other than the turbocharger TC, or may be a stand-alone unit.

As shown in FIG. 1, the turbocharger TC comprises a turbocharger body 1. The turbocharger body 1 includes a bearing housing 2, a turbine housing 4, a compressor housing (housing) 100, and a link mechanism 200. Details of the link mechanism 200 will be described later. The turbine housing 4 is connected to the left side of the bearing housing 2 by fastening bolts 3. The compressor housing 100 is connected to the right side of the bearing housing 2 by fastening bolts 5.

An accommodation hole 2*a* is formed in the bearing housing 2. The accommodation hole 2*a* passes through the bearing housing 2 in the left-to-right direction of the turbocharger TC. A bearing 6 is arranged in the accommodation hole 2*a*. In FIG. 1, a full floating bearing is shown as an example of the bearing 6. However, the bearing 6 may be any other radial bearing, such as a semi-floating bearing or a rolling bearing. A part of a shaft 7 is arranged in the accommodation hole 2*a*. The shaft 7 is rotatably supported by the bearing 6. A turbine impeller 8 is provided at a left end of the shaft 7. The turbine impeller 8 is rotatably housed in the turbine housing 4. A compressor impeller 9 is provided at a right end of shaft 7. In the present disclosure, a rotational axis direction, a radial direction, and a circumferential direction of the shaft 7, the turbine impeller 8, and the compressor impeller 9 may simply be referred to as the rotational axis direction, the radial direction, and the circumferential direction, respectively. The compressor impeller 9 is rotatably housed in the compressor housing 100. The compressor impeller 9 includes a plurality of long blades 9*a* and a plurality of short blades 9*b* formed on an outer circumference surface of a hub. The plurality of long blades 9*a* and short blades 9*b* are formed alternately spaced apart from each other in the circumferential direction. The plurality of long blades 9*a* and short blades 9*b* are formed at equal intervals in the circumferential direction. A leading edge LE of the long blade 9*a* is positioned spaced apart from the bearing housing 2 with respect to a leading edge LE of the short blade 9*b*. In other words, the leading edge LE of the short blade 9*b* is positioned closer to the bearing housing 2 with respect to the leading edge LE of the long blade 9*a*. In the present embodiment, the compressor impeller 9 includes the long blades 9*a* and the short blades 9*b*. However, the compressor impeller 9 is not limited thereto, and may include only one of the long blades 9*a* and the short blades 9*b*.

An inlet 10 is formed in the compressor housing 100. The inlet 10 opens to the right side of the turbocharger TC. The inlet 10 is connected to an air cleaner (not shown). A diffuser flow path 11 is formed between the bearing housing 2 and the compressor housing 100. The diffuser flow path 11 pressurizes air. The diffuser flow path 11 is formed in an annular shape from a radially inner side to an outer side. The diffuser flow path 11 is connected to the intake flow path 10 via the compressor impeller 9 at a radially inner part.

A compressor scroll flow path 12 is formed in the compressor housing 100. For example, the compressor scroll flow path 12 is located radially outside the compressor impeller 9. The compressor scroll flow path 12 is connected to an intake port of an engine (not shown) and the diffuser flow path 11. As the compressor impeller 9 rotates, air is sucked into the compressor housing 100 from the inlet 10. The sucked air is pressurized and accelerated while passing through the blades of the compressor impeller 9. The pressurized and accelerated air is further pressurized in the diffuser flow path 11 and the compressor scroll flow path 12. The pressurized air flows out from an outlet (not shown) and is directed to the intake port of the engine.

As such, the turbocharger TC comprises the centrifugal compressor (compressor) CC that pressurizes fluid with using centrifugal force. The centrifugal compressor CC includes the compressor housing 100, the compressor impeller 9, and the link mechanism 200 described later.

An outlet 13 is formed in the turbine housing 4. The outlet 13 opens to the left side of the turbocharger TC. The outlet 13 is connected to an exhaust gas purifier (not shown). A connecting flow path 14 and a turbine scroll flow path 15 are formed in the turbine housing 4. The turbine scroll flow path 15 is located radially outside the turbine impeller 8. The connecting flow path 14 is located between the turbine impeller 8 and the turbine scroll flow path 15.

The turbine scroll flow path 15 is connected to a gas inlet (not shown). Exhaust gas discharged from an exhaust manifold of the engine (not shown) is directed to the gas inlet. The connecting flow path 14 connects the turbine scroll flow path 15 to the outlet 13. The exhaust gas directed from the gas inlet to the turbine scroll flow path is directed to the outlet 13 through the connecting flow path 14 and blades of the turbine impeller 8. The exhaust gas rotates the turbine impeller 8 when passing therethrough.

A rotational force of the turbine impeller 8 is transmitted to the compressor impeller 9 via the shaft 7. As described above, air is pressurized by the rotational force of the compressor impeller 9 and directed to the intake port of the engine.

Figure 2:
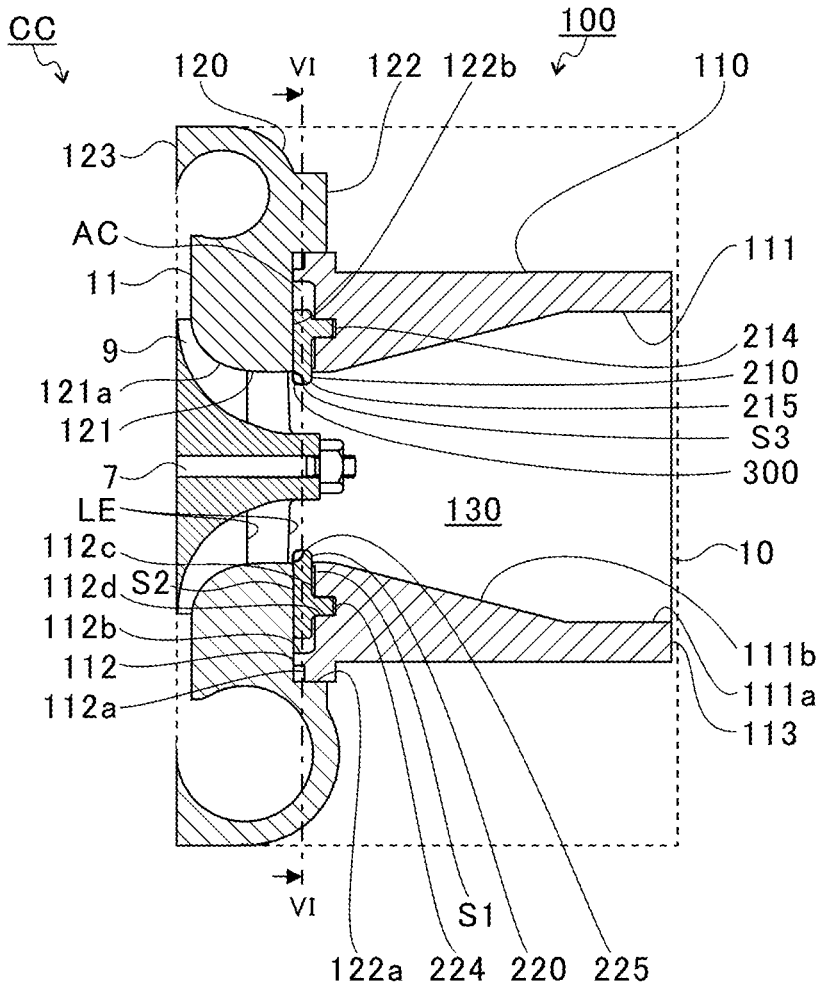
FIG. 2 is an extracted view of a part enclosed by dashed lines in FIG. 1.

FIG. 2 is an extracted view of a part enclosed by dashed lines in FIG. 1. As shown in FIG. 2, the compressor housing 100 includes a first housing member 110 and a second housing member 120. The first housing member 110 is located on the right side (a side spaced apart from the bearing housing 2) in FIG. 2 with respect to the second housing member 120. The second housing member 120 is connected to the bearing housing 2. The first housing member 110 is connected to the second housing member 120 in the rotational axis direction.

The first housing member 110 has a substantially cylindrical shape. A through hole 111 is formed in the first housing member 110. The first housing member 110 includes an end face 112 on a side adjacent (connected) to the second housing member 120. The first housing member 110 also includes an end face 113 on a side spaced apart from the second housing member 120. The inlet 10 is formed on the end face 113. The through hole 111 extends from the end face 112 to the end face 113 (inlet 10) along the rotational axis direction. In other words, the through hole 111 passes through the housing member 110 in the rotational axis direction. The through hole 111 includes the inlet 10 on the end face 113.

The through hole 111 includes a parallel portion 111*a* and a tapered portion 111*b*. The parallel portion 111*a* is located closer to the end face 113 with respect to the tapered portion 111*b*. An inner diameter of the parallel portion 111*a* is substantially constant over the rotational axis direction. The tapered portion 111*b* is located closer to the end face 112 with respect to the parallel portion 111*a*. The tapered portion 111*b* is continuous with the parallel portion 111*a*. An inner diameter at the continuous part of the tapered portion 111*b* is substantially equal to the inner diameter of the parallel portion 111*a*. The inner diameter of the tapered portion 111*b* decreases as it is spaced apart from the parallel portion 111*a* (as approaching the end face 112).

A notch 112*a* is formed on the end face 112. The notch 112*a* is recessed from the end face 112 toward the end face 113. The notch 112*a* is formed at an outer periphery of the end face 112. For example, the notch 112*a* has a substantially annular shape when seen from the rotational axis direction.

An accommodation chamber AC is formed on the end face 112. The accommodation chamber AC is formed in the first housing member 110 so as to be closer to the inlet 10 with respect to the leading edge LE of the long blade 9*a* of the compressor impeller 9. The accommodation chamber AC includes an accommodation groove 112*b*, bearing holes 112*d*, and an accommodation hole 115 (see FIG. 3), which will be described later.

The accommodation groove 112*b* is formed on the end face 112. The accommodation groove 112*b* is located between the notch 112*a* and the through hole 111. The accommodation groove 112*b* is recessed from the end face 112 toward the end face 113. For example, the accommodation groove 112*b* has a substantially annular shape when seen from the rotational axis direction. The accommodation groove 112*b* is connected to the through hole 111 at a radially inner part.

The bearing holes 112*d* are formed on a wall surface 112*c* parallel to the end face 113 in the accommodation groove 112*b*. The bearing holes 112*d* extend from the wall surface 112*c* toward the end face 113 in the rotational axis direction. Two bearing holes 112*d* are provided so as to be spaced apart from each other in the rotational direction. The two bearing holes 112*d* are arranged spaced apart from each other by 180 degrees in the rotational direction.

A through hole 121 is formed in the second housing member 120. The second housing member 120 includes an end face 122 on a side adjacent (connected) to the first housing member 110. Furthermore, the second housing member 120 includes an end face 123 on a side spaced apart from the first housing member 110 (side connected to the bearing housing 2). The through hole 121 extends from the end face 122 to the end face 123 along the rotational axis direction. In other words, the through hole 121 passes through the second housing member 120 in the rotational axis direction.

An inner diameter of the through hole 121 at an end closer to the end face 122 is substantially equal to the inner diameter of the through hole 111 at an end closer to the end face 112. A shroud portion 121*a* is formed on an inner wall of the through hole 121. The shroud portion 121*a* faces the compressor impeller 9 from a radially outer side. An outer diameter of the compressor impeller 9 increases as it is spaced apart from the leading edge LE of the long blade 9*a* of the compressor impeller 9 in the rotational axis direction. An inner diameter of the shroud portion 121*a* increases as it is spaced apart from the end face 122 (as approaching the end face 123).

An accommodation groove 122*a* is formed in the end face 122. The accommodation groove 122*a* is recessed from the end face 122 toward the end face 123. For example, the accommodation groove 122*a* has a substantially annular shape when seen from the rotational axis direction. The first housing member 110 is inserted into the accommodation groove 122*a*. The end face 112 of the first housing member 110 contacts a wall surface 122*b* parallel to the end face 123 in the accommodation groove 122*a*. The accommodation chamber AC is formed between the first housing member 110 (wall surface 112*c*) and the second housing member 120 (wall surface 122*b*).

The through hole 111 of the first housing member 110 and the through hole 121 of the second housing member 120 form an intake flow path 130. As such, the intake flow path 130 is formed in the compressor housing 100. The intake flow path 130 is connected from the air cleaner (not shown) to the diffuser flow path 11 via the inlet 10. A side closer to the air cleaner (inlet 10) of the intake flow path 130 is referred to as an upstream side in a flow of intake air, and a side closer to the diffuser flow path 11 of the intake flow path 130 is referred to as a downstream side in the flow of the intake air.

The compressor impeller 9 is arranged in the intake flow path 130. The cross-sectional shape of the intake flow path 130 (through holes 111 and 121) perpendicular to the rotational axis direction is, for example, circular around the rotational axis of the compressor impeller 9. However, the cross-sectional shape of the intake flow path 130 is not limited thereto, and may be, for example, elliptical.

A seal (not shown) is arranged in the notch 112*a* of the first housing member 110. The seal curbs a flow rate of air flowing in a gap between the first housing member 110 and the second housing member 120. However, the notch 112*a* and the seal are not essential.

Figure 3:
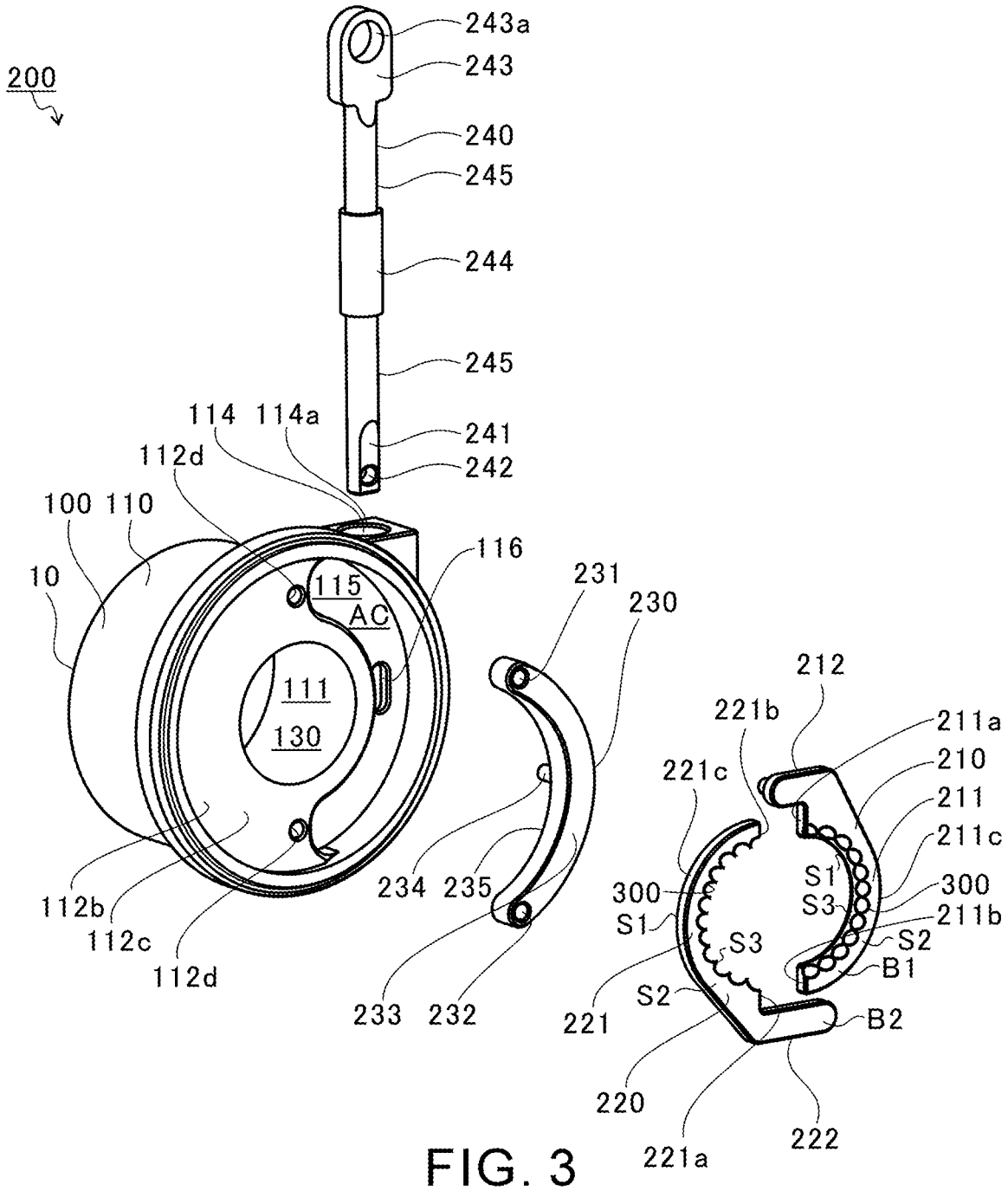
FIG. 3 is an exploded perspective view of components included in a link mechanism.

FIG. 3 is an exploded perspective view of components included in the link mechanism 200. In FIG. 3, only the first housing member 110 of the compressor housing 100 is shown. As shown in FIG. 3, the link mechanism 200 includes the first housing member 110, a first movable member 210, a second movable member 220, a connecting member 230, and a rod 240. Hereinafter, the first movable member 210 and the second movable member 220 are also collectively referred to as movable members 210 and 220. The link mechanism 200 is arranged closer to the inlet 10 (upstream side) of the intake flow path 130 with respect to the compressor impeller 9 in the rotational axis direction.

The first movable member 210 is arranged in the accommodation groove 112*b* (accommodation chamber AC). Specifically, the first movable member 210 is arranged between the wall surface 112*c* of the accommodation groove 112*b* and the wall surface 122*b* of the accommodation groove 122*a* (see FIG. 2) in the rotational axis direction. The first movable member 210 includes an opposing surface S1 facing the wall surface 112*c* of the accommodation groove 112*b*, an opposing surface S2 facing the wall surface 122*b* of the accommodation groove 122*a*, and an inner circumferential surface S3. In the first movable member 210, the opposing surface S2 is a side face closer to the blades 9*a* and 9*b* of the compressor impeller 9. The first movable member 210 includes a body B1. The body B1 includes a curved portion 211 and an arm 212.

The curved portion 211 extends in the circumferential direction. The curved portion 211 has a substantially semi-arc shape. One end face 211*a* and the other end face 211*b* of the curved portion 211 in the circumferential direction extend parallel to the radial direction and the rotational axis direction. However, the one end face 211*a* and the other end face 211*b* may be inclined with respect to the radial direction and the rotational axis direction.

The arm 212 is provided on the one end face 211*a* of the curved portion 211. The arm 212 extends radially outward from an outer circumferential surface 211*c* of the curved portion 211. Furthermore, the arm 212 extends in a direction inclined with respect to the radial direction (toward the second movable member 220).

The second movable member 220 is arranged in the accommodation groove 112*b* (accommodation chamber AC). Specifically, the second movable member 220 is arranged between the wall surface 112*c* of the accommodation groove 112*b* and the wall surface 122*b* of the accommodation groove 122*a* (see FIG. 2) in the rotational axis direction. The second movable member 220 includes an opposing surface S1 facing the wall surface 112*c* of the accommodation groove 112*b*, an opposing surface S2 facing the wall surface 122*b* of the accommodation groove 122*a*, and an inner circumferential surface S3. In the second movable member 220, the opposing surface S2 is a side face closer to the blades 9*a* and 9*b* of the compressor impeller 9. The second movable member 220 includes a body B2. The body B2 includes a curved portion 221 and an arm 222.

The curved portion 221 extends in the circumferential direction. The curved portion 221 has a substantially semi-arc shape. One end face 221*a* and the other end face 221*b* of the curved portion 221 in the circumferential direction extend parallel to the radial direction and the rotational axis direction. However, the one end face 221*a* and the other end face 221*b* may be inclined with respect to the radial direction and the rotational axis direction.

The arm 222 is provided on the one end face 221*a* of the curved portion 221. The arm 222 extends radially outward from an outer circumferential surface 221*c* of the curved portion 221. Furthermore, the arm 222 extends in a direction inclined with respect to the radial direction (toward the first movable member 210).

The curved portion 211 faces the curved portion 221 across the center of rotation of the compressor impeller 9 (intake flow path 130). The one end face 211*a* of the curved portion 211 circumferentially faces the other end face 221*b* of the curved portion 221. The other end face 211*b* of the curved portion 211 circumferentially faces the one end face 221*a* of the curved portion 221. The first movable member 210 and the second movable member 220 are configured so that the curved portions 211 and 221 are movable in the radial direction, as described later in detail.

Figure 4:
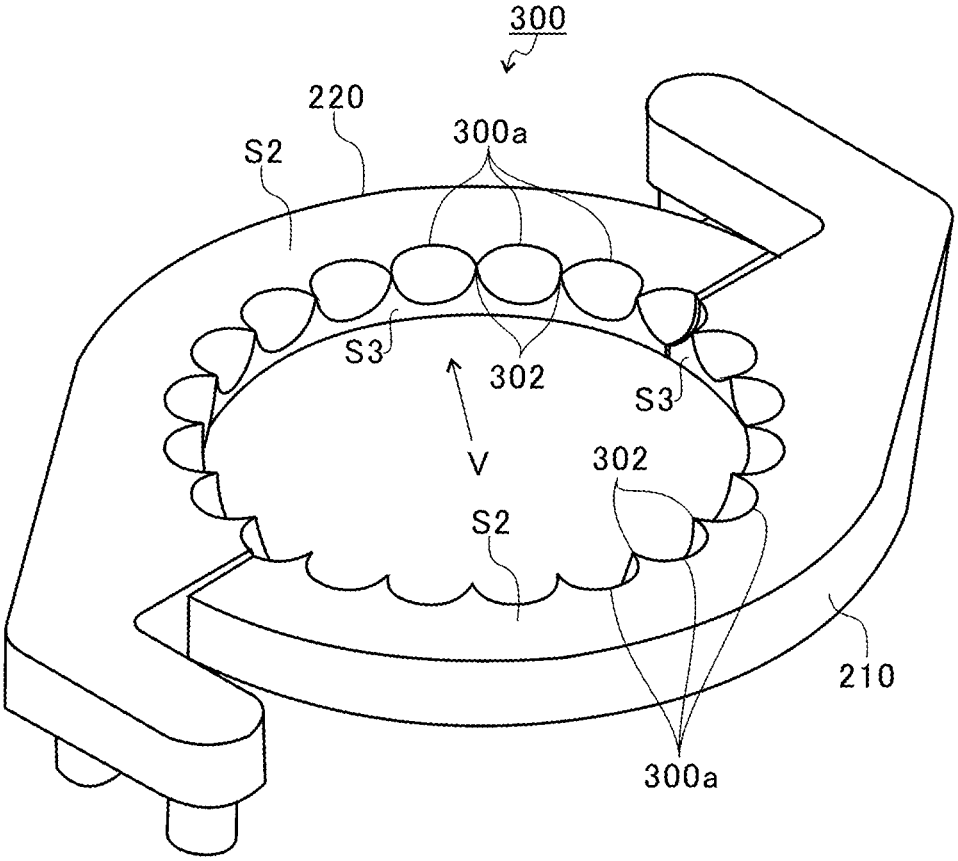
FIG. 4 is a schematic perspective view of movable members according to the first embodiment.

FIG. 4 is a schematic perspective view of the movable members 210 and 220 according to the first embodiment. As shown in FIG. 4, one or more grooves 300 are formed on the movable members 210 and 220. The grooves 300 are formed on the movable member 210 and 220 at an inner circumferential edge of the opposing surface S2 closer to the blades 9*a* and 9*b* of the compressor impeller 9. The grooves 300 are formed over the inner circumferential surface S3 and the opposing surface S2 in the movable members 210 and 220.

The grooves 300 of the first embodiment include a plurality of spherical grooves 300*a* arranged in the circumferential direction. The plurality of spherical grooves 300*a* are formed next to each other in the circumferential direction. The plurality of spherical grooves 300*a* have the same size as each other. However, the plurality of spherical grooves 300*a* is not limited thereto, and may have different sizes and different shapes from each other.

The plurality of spherical grooves 300*a* of the first embodiment are formed at equal intervals in the circumferential direction. Protrusions 302 are formed between the plurality of spherical grooves 300*a*. The protrusions 302 are formed adjacent to the grooves 300*a* in the circumferential direction. The protrusions 302 partition off the plurality of spherical grooves 300*a* in the circumferential direction.

A radially inward end face of the protrusion 302 is flush with the inner circumferential surface S3. Furthermore, an end face of the protrusion 302 closer to the blades 9*a* and 9*b* of the compressor impeller 9 is flush with the opposing surface S2. However, the radially inward end face of the protrusion 302 is not limited thereto, and may project radially inward with respect to the inner circumferential surface S3, or may be recessed radially outward with respect to the inner circumferential surface S3. Furthermore, the end face of the protrusion 302 closer to the blades 9*a* and 9*b* of the compressor impeller 9 may project in a direction toward the blades 9*a* and 9*b* with respect to the opposing surface S2, or may be recessed in a direction spaced apart from the blades 9*a* and 9*b* with respect to the opposing surface S2.

In the first embodiment, the example in which the plurality of spherical grooves 300*a* and the plurality of protrusions 302 are provided on the movable members 210 and 220 is described. However, the movable members 210 and 220 may be provided with a single spherical groove 300*a* and protrusion 302. The movable members 210 and 220 may only be provided with at least one groove 300*a* and protrusion 302. Thus, for example, only one spherical groove 300*a* may be formed in the movable members 210 and 220. In this case, the single groove 300*a* may only be formed on one of the first movable member 210 and the second movable member 220, or may be formed over both the first movable member 210 and the second movable member 220.

Figure 5:
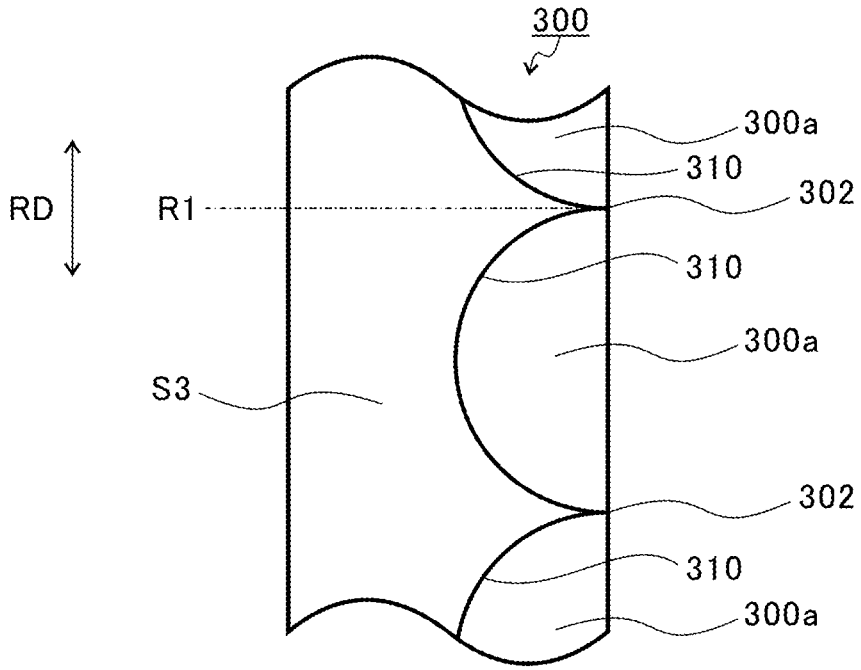
FIG. 5 shows an inner circumferential surface of the movable member seen from a radially inner side in FIG. 4.

FIG. 5 shows the inner circumferential surface S3 of the movable members 210 and 220 seen from a radially inner side in FIG. 4. As shown in FIG. 5, since the plurality of spherical grooves 300*a* are formed in the inner circumferential surface S3, arc ends 310 having an arc shape are formed so as to face a direction toward the blades 9*a* and 9*b* of the compressor impeller 9. The arc end 310 has a shape that is inclined in the circumferential direction RD with respect to the rotational axis direction R1.

Returning to FIG. 3, the connecting member 230 connects with the first movable member 210 and the second movable member 220. The connecting member 230 is located closer to the inlet 10 with respect to the first movable member 210 and the second movable member 220. The connecting member 230 has a substantially arc shape. A first bearing hole 231 is formed at one end and a second bearing hole 232 is formed at the other end of the connecting member 230 in the circumferential direction. In the connecting member 230, the first bearing hole 231 and the second bearing hole 232 are opened on the end face 233 closer to the first movable member 210 and the second movable member 220. The first bearing hole 231 and the second bearing hole 232 extend in the rotational axis direction. In the present embodiment, the first bearing hole 231 and the second bearing hole 232 are non-through holes. However, the first bearing hole 231 and the second bearing hole 232 may pass through the connecting member 230 in the rotational axis direction.

A rod connector 234 is formed in the connecting member 230 between the first bearing hole 231 and the second bearing hole 232. In the connecting member 230, the rod connector 234 is formed on the end face 235 opposite to the first movable member 210 and the second movable member 220. The rod connector 234 protrudes from the end face 235 in the rotational axis direction. The rod connector 234 has, for example, a substantially cylindrical shape.

The rod 240 has a substantially cylindrical shape. A flat portion 241 is formed at one end of the rod 240, and a connecting portion 243 is formed at the other end. The flat portion 241 extends in a plane direction that is substantially perpendicular to the rotational axis direction. A bearing hole 242 is opened on the flat portion 241. The bearing hole 242 extends in the rotational axis direction. The connecting portion 243 includes a connecting hole 243*a*. The connecting portion 243 (connecting hole 243*a*) is connected to an actuator described later. The bearing hole 242 may be, for example, an elongated hole whose length in the direction perpendicular to the rotational axis direction and an axial direction of the rod 240 (left-to-right direction in FIG. 7, described below) is longer than a length in the axial direction of the rod 240.

A rod large diameter portion 244 and two rod small diameter portions 245 are formed between the flat portion 241 and the connecting portion 243 in the rod 240. The rod large diameter portion 244 is located between the two rod small diameter portions 245. Between the two rod small diameter portions 245, the rod small diameter portion 245 closer to the flat portion 241 connects the rod large diameter portion 244 to the flat portion 241. Between the two rod small diameter portions 245, the rod small diameter portion 245 closer to the connection portion 243 connects the rod large diameter portion 244 to the connecting portion 243. An outer diameter of the rod large diameter portion 244 is larger than outer diameters of the two rod small diameter portions 245.

An insertion hole 114 is formed in the first housing member 110. One end 114*a* of the insertion hole 114 opens to the outside of the first housing member 110. The insertion hole 114 extends, for example, in a plane direction perpendicular to the rotational axis direction. The insertion hole 114 is located radially outside the through hole 111 (intake flow path 130). A side including the flat portion 241 of the rod 240 is inserted into the insertion hole 114. The rod large diameter portion 244 is guided by an inner wall of the insertion hole 114. The rod 240 is prevented from moving except in the central axial direction of the insertion hole 114 (the central axial direction of the rod 240).

An accommodation hole 115 is formed in the first housing member 110. The accommodation hole 115 is opened on the wall surface 112*c* of the accommodation groove 112*b*. The accommodation hole 115 is recessed from the wall surface 112*c* toward the inlet 10. The accommodation hole 115 is located spaced apart from the inlet 10 (closer to the second housing member 120) with respect to the insertion hole 114. The accommodation hole 115 has a substantially arc shape when seen from the rotational axis direction. The accommodation hole 115 extends longer than the connecting member 230 in the circumferential direction. The accommodation hole 115 is circumferentially spaced apart from the bearing holes 112*d*.

A communication hole 116 is formed in the first housing member 110. The communication hole 116 connects the insertion hole 114 to the accommodation hole 115. The communication hole 116 is formed substantially in the middle of the accommodation hole 115 in the circumferential direction. The communication hole 116 is, for example, an elongated hole extending substantially parallel to the extending direction of the insertion hole 114. In the communication hole 116, a width in the longitudinal direction (extending direction) is greater than a width in the lateral direction (direction perpendicular to the extending direction). A width of the insertion hole 114 in the lateral direction is greater than an outer diameter of the rod connector 234 of the connecting member 230.

The connecting member 230 is accommodated in the accommodation hole 115 (accommodation chamber AC). As such, the first movable member 210, the second movable member 220, and the connecting member 230 are arranged in the accommodation chamber AC formed in the first housing member 110. The accommodation hole 115 is circumferentially longer and radially larger than the connecting member 230. Accordingly, the connecting member 230 is allowed to move within the accommodation hole 115 in the plane direction perpendicular to the rotational axis direction.

The rod connector 234 is inserted through the communication hole 116 into the insertion hole 114. The flat portion 241 of the rod 240 is inserted into the insertion hole 114. The bearing hole 242 of the flat portion 241 faces the communication hole 116. The rod connector 234 is inserted into (connected to) the bearing hole 242. The rod connector 234 is supported by the bearing hole 242.

Figure 6:
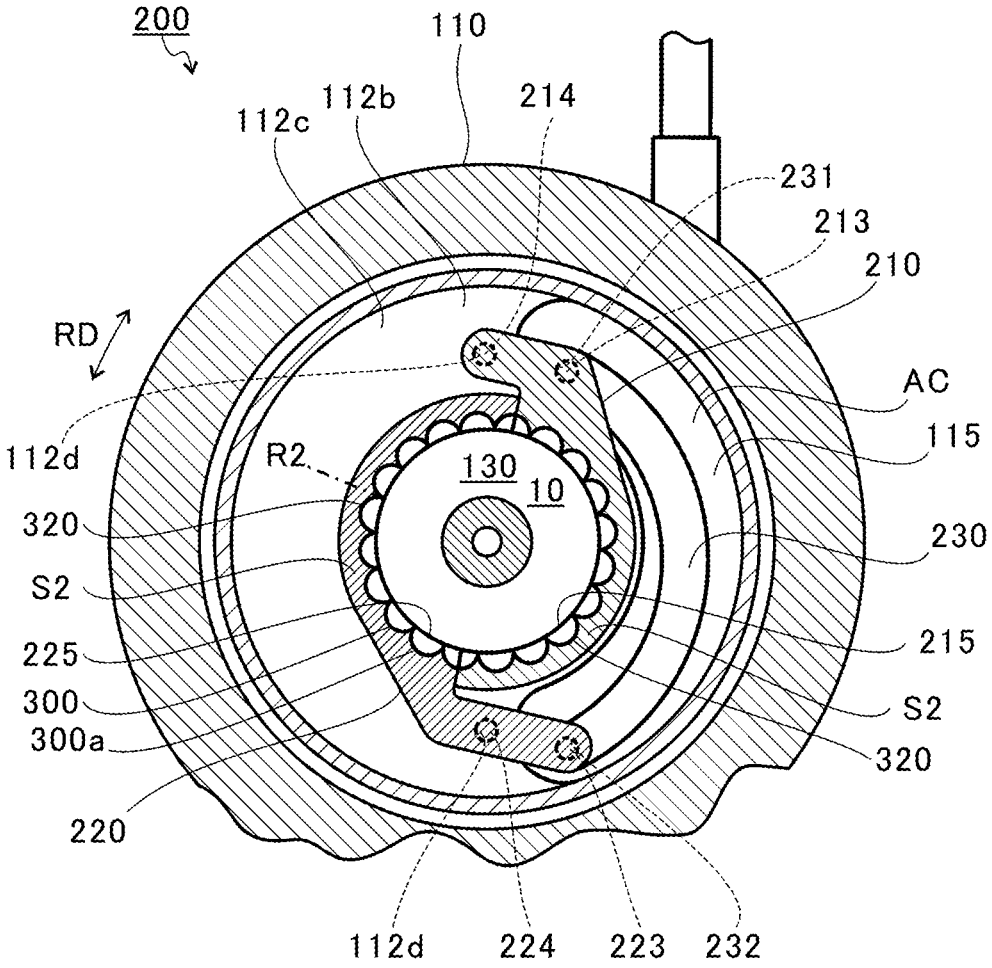
FIG. 6 is a cross-sectional view taken along line VI-VI in FIG. 2.

FIG. 6 is a cross-sectional view taken along line VI-VI in FIG. 2. As shown in FIG. 6, the plurality of spherical grooves 300*a* are formed on the opposing surfaces S2 of the movable members 210 and 220, thereby forming arc ends 320 having an arc shape in radially inner parts. The arc ends 320 have a shape that is inclined with respect to the radial direction R2 in the circumferential direction RD.

As shown in dashed lines in FIG. 6, the first movable member 210 includes a connecting shaft 213 and a rotational shaft 214. In the first movable member 210, the connecting shaft 213 and the rotational shaft 214 protrude in the rotational axis direction from the opposing surface S1 (see FIG. 2) that faces the wall surface 112*c*. The connecting shaft 213 and the rotational shaft 214 extend toward the back side of the paper in FIG. 5. The rotational shaft 214 extends parallel to the connecting shaft 213. The connecting shaft 213 and rotational shaft 214 have a substantially cylindrical shape.

An outer diameter of the connecting shaft 213 is smaller than an inner diameter of the first bearing hole 231 of the connecting member 230. The connecting shaft 213 is inserted into the first bearing hole 231. The connecting shaft 213 is rotatably supported by the first bearing hole 231. An outer diameter of the rotational shaft 214 is smaller than an inner diameter of the bearing hole 112*d* of the first housing member 110. The rotational shaft 214 is inserted into the bearing hole 112*d* on the vertically upper side (closer to the rod 240) of the two bearing holes 112*d*. The rotational shaft 214 is rotatably supported by the bearing hole 112*d*. The rotational shaft 214 connects the first movable member 210 to the wall surface 112*c* that faces the first movable member 210 in the rotational axis direction.

The second movable member 220 includes a connecting shaft 223 and a rotational shaft 224. In the second movable member 220, the connecting shaft 223 and the rotational shaft 224 protrude in the rotational axis direction from the opposing surface S1 (see FIG. 2) that faces the wall surface 112*c*. The connecting shaft 223 and the rotational shaft 224 extend toward the back side of the paper in FIG. 4. The rotational shaft 224 extends parallel to the connecting shaft 223. The connecting shaft 223 and the rotational shaft 224 have a substantially cylindrical shape.

An outer diameter of the connecting shaft 223 is smaller than an inner diameter of the second bearing hole 232 of the connecting member 230. The connecting shaft 223 is inserted into the second bearing hole 232. The connecting shaft 223 is rotatably supported by the second bearing hole 232. An outer diameter of the rotational shaft 224 is smaller than an inner diameter of the bearing hole 112*d* of the first housing member 110. The rotational shaft 224 is inserted into the bearing hole 112*d* on the vertically lower side (spaced apart from the rod 240) of the two bearing holes 112*d*. The rotational shaft 224 is rotatably supported by the bearing hole 112*d*. The rotational shaft 224 connects the second movable member 220 to the wall surface 112*c* that faces the second movable member 220 in the rotational axis direction.

As described above, the link mechanism 200 includes a four-bar linkage. The four links (nodes) are the first movable member 210, the second movable member 220, the first housing portion 110, and the connecting portion 230. Since the link mechanism 200 includes the four-bar linkage, it is a limited chain, has one degree of freedom, and is easy to control.

Figure 7:
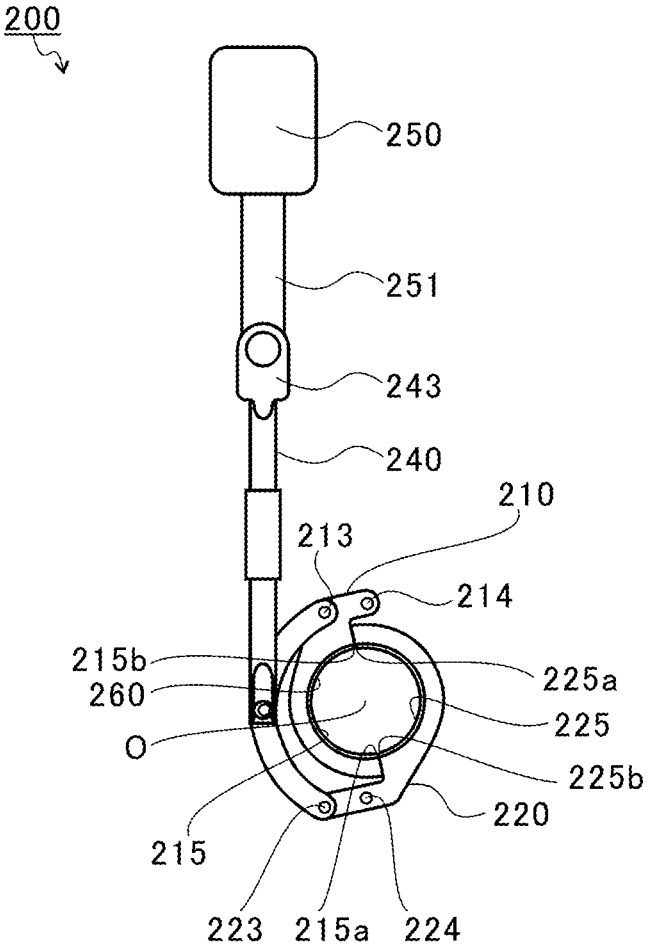
FIG. 7 is a first illustration of an operation of the link mechanism.

FIG. 7 is a first illustration of an operation of the link mechanism 200. In the following FIGS. 7, 8 and 9, the link mechanism 200 is seen from the inlet 10. As shown in FIG. 7, one end of a drive shaft 251 of an actuator 250 is connected to the connecting portion 243 of the rod 240.

In the arrangement shown in FIG. 7, the first movable member 210 and the second movable member 220 are in contact with each other. In this situation, as shown in FIGS. 2 and 6, a protruding portion 215 that is a radially inner part of the first movable member 210 protrudes (is exposed) into the intake flow path 130. A protruding portion 225 that is a radially inner part of the second movable member 220 protrudes (is exposed) into the intake flow path 130. The positions of the first movable member 210 and the second movable member 220 in this situation are referred to as a protruding position (or a throttling position). As shown in FIG. 2, inner surfaces of the protruding portions 215 and 225 are the inner circumferential surfaces S3. As such, the protruding portions 215 and 225 include the inner circumferential surfaces S3.

As shown in FIG. 7, in the protruding position, ends 215*a* and 215*b* of the protruding portion 215 in the circumferential direction and ends 225*a* and 225*b* of the protruding portion 225 in the circumferential direction contact each other. The protruding portions 215 and 225 form an annular hole 260. An inner diameter of the annular hole 260 is smaller than the inner diameter of the intake flow path 130 at a position where the protruding portions 215 and 225 protrude. For example, the inner diameter of the annular hole 260 is smaller than the inner diameter of the intake flow path 130 at any positions.

Figure 8:
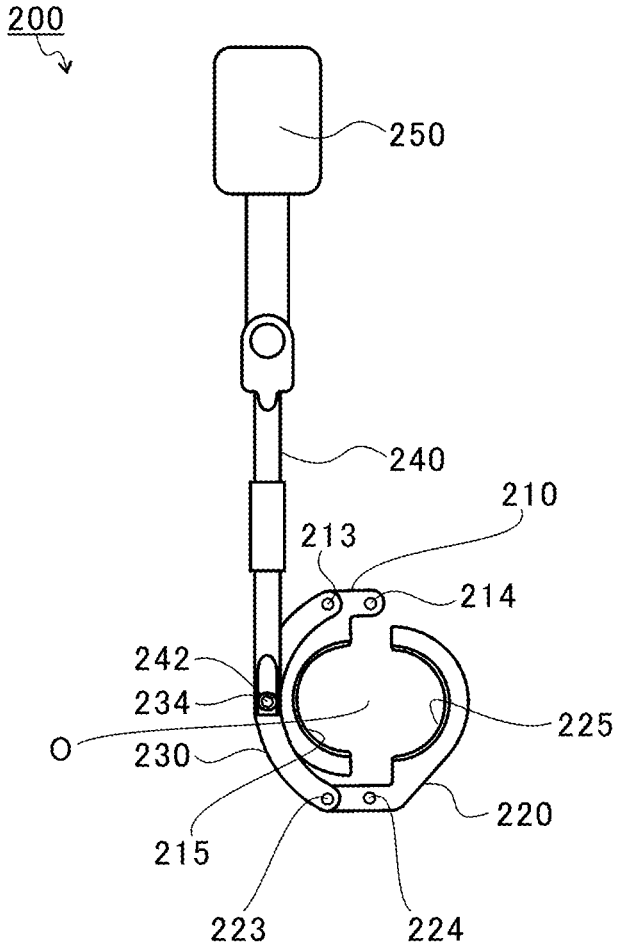
FIG. 8 is a second illustration of the operation of the link mechanism.
Figure 9:
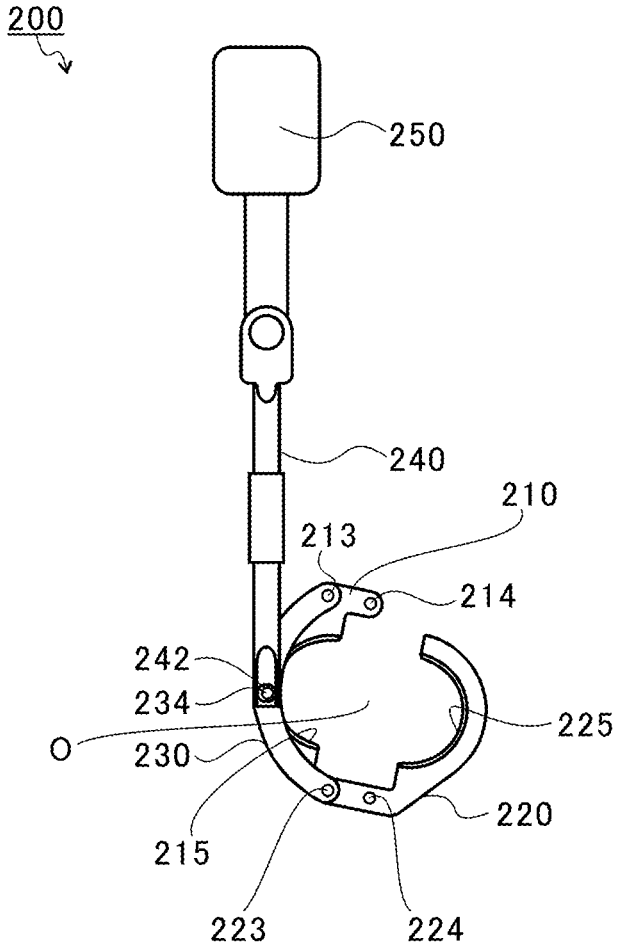
FIG. 9 is a third illustration of the operation of the link mechanism.

FIG. 8 is a second illustration of the operation of the link mechanism 200. FIG. 9 is a third illustration of the operation of the link mechanism 200. The actuator 250 linearly moves the rod 240 in a direction that intersects the rotational axis direction (up-and-down direction in FIGS. 8 and 9). The rod 240 moves upward from the position shown in FIG. 7. With regard to an amount of movement from the arrangement shown in FIG. 7, the arrangement shown in FIG. 9 is larger than the arrangement shown in FIG. 8.

As the rod 240 moves, the connecting member 230 moves upward in FIGS. 8 and 9 via the rod connector 234. In this situation, the connecting member 230 is allowed to rotate around the rod connector 234. Furthermore, there is a slight play between the inner diameter of the bearing hole 242 of the rod 240 and the outer diameter of the rod connector 234. Accordingly, the connecting member 230 is allowed to slightly move in the plane direction perpendicular to the rotational axis direction.

As described above, the link mechanism 200 is the four-bar linkage. The connecting member 230, the first movable member 210, and the second movable member 220 exhibit a behavior of one degree of freedom with respect to the first housing member 110. Specifically, the connecting member 230 slightly moves in the left-to-right direction while slightly rotating counterclockwise in FIGS. 8 and 9 within the allowable range described above.

The rotational shaft 214 of the first movable member 210 is supported by the first housing member 110. The rotational shaft 214 is prevented from moving in the plane direction perpendicular to the rotational axis direction. The connecting shaft 213 is supported by the connecting member 230. Since the connecting member 230 is allowed to move, the connecting shaft 213 is movable in the plane direction perpendicular to the rotational axis direction. As a result, as the connecting member 230 moves, the first movable member 210 rotates in a clockwise direction in FIGS. 8 and 9 around the rotational shaft 214.

Similarly, the rotational shaft 224 of the second movable member 220 is supported by the first housing member 110. The rotational shaft 224 is prevented from moving in the plane direction perpendicular to the rotational axis direction. The connecting shaft 223 is supported by the connecting member 230. Since the connecting shaft 223 is allowed to move, the connecting shaft 223 is movable in the plane direction perpendicular to the rotational axis direction. As a result, as the connecting member 230 moves, the second movable member 220 rotates in a clockwise direction in FIGS. 8 and 9 around the rotational shaft 224.

As such, the first movable member 210 and the second movable member 220 move in directions spaced apart from each other in the order of FIG. 8 to FIG. 9. The protruding portions 215 and 225 move to a radially outer side (retracted position) with respect to the protruding position. In the retracted position, for example, the protruding portions 215 and 225 are flush with an inner wall of the intake flow path 130 or are located radially outside the inner wall of the intake flow path 130. When moving from the retracted position to the protruding position, the first movable member 210 and the second movable member 220 approach and contact each other in the order of FIG. 9 to FIG. 7. As such, the first movable member 210 and the second movable member 220 switch between the protruding position and the retracted position according to rotational angles around the rotational shafts 214 and 224.

As described above, the first movable member 210 and the second movable member 220 are movable to the protruding position where they protrude into the intake flow path 130, and a retracted position where they are retracted from the intake flow path 130. In the present embodiment, the first movable member 210 and the second movable member 220 move in the radial direction. However, the first movable member 210 and the second movable member 220 are not limited thereto, and may rotate around the rotational axis (in the circumferential direction) of the compressor impeller 9. For example, the first movable member 210 and the second movable member 220 may be shutter blades having two or more blades.

The first movable member 210 and the second movable member 220 do not protrude into the intake flow path 130 when in the retracted position, thus reducing pressure loss of intake gas (air) flowing in the intake flow path 130.

Furthermore, as shown in FIG. 2, in the first movable member 210 and the second movable member 220, the protruding portions 215 and 225 are arranged in the intake flow path 130 in the protruding position. When the first movable member 210 and the second movable member 220 are in the protruding position, the cross-sectional area of the intake flow path 130 decreases.

As a flow rate of air flowing into the compressor impeller 9 decreases, air compressed by the compressor impeller 9 may flow backward (i.e., the air flows from the downstream side to the upstream side) in the intake flow path 130.

As shown in FIG. 2, when the first movable member 210 and the second movable member 220 are in the protruding position, the protruding portions 215 and 225 are located radially inside with respect to the radially outermost end of the leading edge LE of the long blade 9*a* of the compressor impeller 9. As a result, the air flowing backward in the intake flow path 130 is blocked by the protruding portions 215 and 225. Accordingly, the first movable member 210 and the second movable member 220 can curb the backflow of air in the intake flow path 130.

In addition, since the cross-sectional area of the intake flow path 130 decreases, velocity of the air flowing into the compressor impeller 9 increases. As a result, occurrence of surging in the centrifugal compressor CC can be curbed. In other words, the centrifugal compressor CC of the present embodiment can expand its operational area to a smaller flow rate area by maintaining the first movable member 210 and the second movable member 220 in the protruding position.

As such, the first movable member 210 and the second movable member 220 are configured as throttles that throttle the intake flow path 130. In other words, in the present embodiment, the link mechanism 200 is configured as a throttling mechanism that throttles the intake flow path 130. The first movable member 210 and the second movable member 220 can change the cross-sectional area of the intake flow path 130 when the link mechanism 200 is driven.

The air flowing backward in the intake flow path 130 includes a swirling flow component caused by the rotation of the compressor impeller 9. When the air flowing backward in the intake flow path 130 is blocked by the movable members 210 and 220, the swirling flow component of the air flowing backward disturbs the flow near the leading edge LE of the long blade 9*a* of the compressor impeller 9, and noise that may be considered as aerodynamic noise may be generated.

Accordingly, in the present embodiment, the grooves 300 are formed in the movable members 210 and 220. The grooves 300 are formed over the inner circumferential surface S3 and the opposing surface S2 of the movable members 210 and 220. In the movable members 210 and 220, the opposing surface S2 is the side face closer to the blades 9*a* and 9*b* of the compressor impeller 9. As such, by forming the grooves 300 on the opposing surface S2, the air flowing backward in the intake flow path 130 enters the grooves 300 and collides with the protrusions 302 in the circumferential direction, thereby reducing the swirling flow component.

When the grooves 300 are only formed on the opposing surface S2, i.e., when a radially inner side of the groove 300 is provided with material and closed thereby, the air flowing backward in the intake flow path 130 is less likely to flow into the grooves 300. In the present embodiment, the grooves 300 are formed over the opposing surface S2 and the inner circumferential surface S3, so that the radially inner side of the grooves 300 are opened without material. Since the radially inner side of the grooves 300 are opened, the air flowing backward is likely to flow into the grooves 300, compared to the case in which the grooves 300 are only formed on the opposing surface S2. As a result, the swirl component of the air flowing backward can be effectively reduced.

Furthermore, the grooves 300 form the arc ends 310 on the inner circumferential surface S3 at positions closer to the blades 9*a* and 9*b* of the compressor impeller 9. The arc ends 310 have a shape that is inclined with respect to the rotational axis direction R1 in the circumferential direction RD. The arc ends 310 allow the air flowing backward to flow smoothly into and out of the grooves 300, thereby reducing the pressure loss.

Furthermore, the grooves 300 form the arc ends 320 on the opposing surface S2 at the radially inner part. The arc ends 320 have a shape that is inclined with respect to the radial direction R2 in the circumferential direction RD. The arc ends 320 allow the air flowing backward to flow smoothly into and out of the grooves 300, thereby reducing the pressure loss.

In addition, since the grooves 300 have a spherical shape, the number of corners can be reduced, compared to the case having a rectangular shape. Accordingly, the grooves 300 having a spherical shape can reduce the swirl flow component more smoothly, compared to the case in which the groove 300 has a rectangular shape, for example.

Second Embodiment

Figure 10:
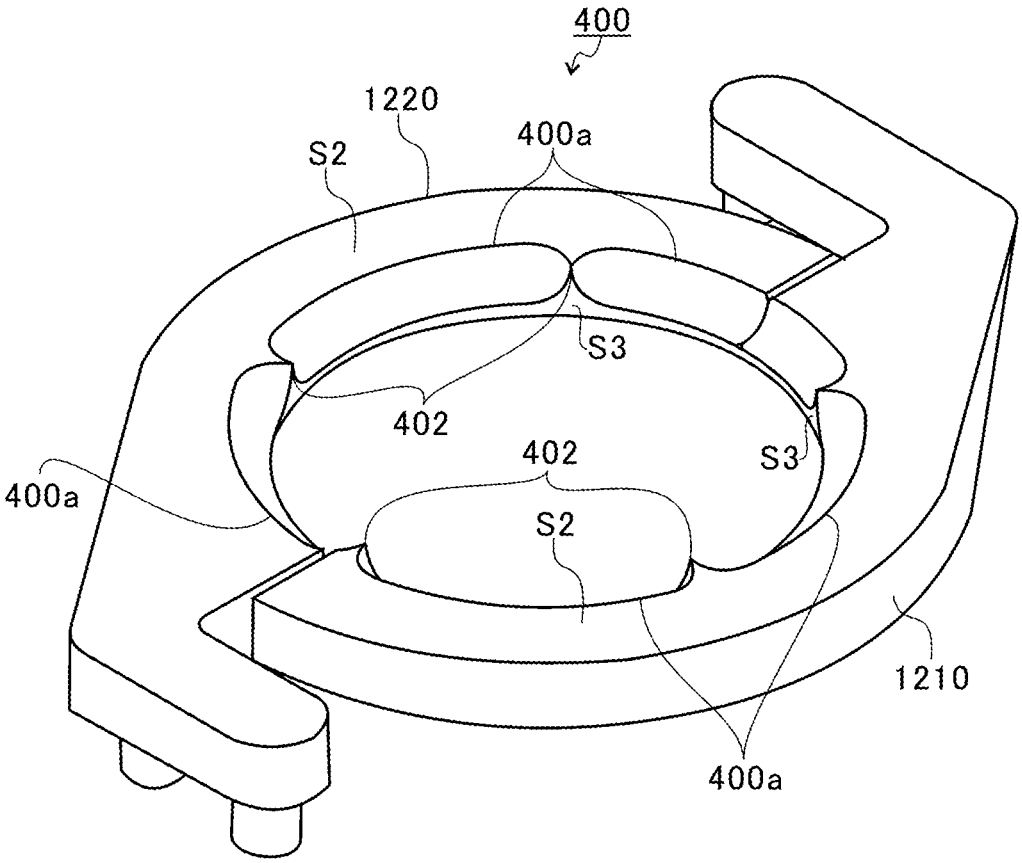
FIG. 10 is a schematic perspective view of movable members according to the second embodiment.

FIG. 10 is a schematic perspective view of movable members 1210 and 1220 according to the second embodiment. Components that are substantially equivalent to those of the centrifugal compressor CC of the above embodiment will be assigned with the same reference signs, and descriptions thereof will be omitted. The movable members 1210 and 1220 of the second embodiment differ from the movable members 210 and 220 of the first embodiment in the shape of the grooves 400.

As shown in FIG. 10, one or more grooves 400 are formed on the movable members 1210 and 1220. The grooves 400 are formed over the inner circumferential surface S3 and the opposing surface S2 of the movable members 1210 and 1220.

The grooves 400 of the second embodiment include a plurality of arc-shaped circumferential grooves 400*a* arranged in the circumferential direction. The plurality of arc-shaped circumferential grooves 400*a* extend in the circumferential direction. The circumferential grooves 400*a* are circumferentially longer than the spherical grooves 300*a* of the first embodiment. The plurality of arc-shaped circumferential grooves 400*a* are formed next to each other in the circumferential direction. The plurality of arc-shaped circumferential grooves 400*a* have the same size as each other. However, the plurality of arc-shaped circumferential grooves 400*a* are not limited thereto, and may have different sizes and different shapes from each other.

The plurality of arc-shaped circumferential grooves 400*a* of the second embodiment are formed at equal intervals in the circumferential direction. Protrusions 402 are formed between the plurality of arc-shaped circumferential grooves 400*a*. The protrusions 402 are formed adjacent to the circumferential grooves 400*a* in the circumferential direction. The protrusions 402 partition off the plurality of arc-shaped circumferential grooves 400*a* in the circumferential direction.

In the second embodiment, the example in which the plurality of arc-shaped circumferential grooves 400*a* and protrusions 402 are provided on the movable members 1210 and 1220 is described. However, the movable members 1210 and 1220 may be provided with a single arc-shaped circumferential groove 400*a* and protrusion 402. The movable members 1210 and 1220 may only be provided with at least one circumferential groove 400*a* and protrusion 402. Accordingly, for example, only one arc-shaped circumferential groove 400*a* may be formed in the movable members 1210 and 1220. In this case, the single circumferential groove 400*a* may only be formed on one of the first movable member 1210 and the second movable member 1220, or may be formed over both the first movable member 1210 and the second movable member 1220.

According to the second embodiment, the number of grooves 400 and protrusions 402 can be reduced compared to the first embodiment by extending the grooves 400 in a circumferential arc. As the number of collisions between the protrusions 402 and the air flowing backward increases, the pressure loss increases and the compressor efficiency decreases. Therefore, by reducing the number of protrusions 402, the decrease in compressor efficiency can be curbed compared to the first embodiment.

Third Embodiment

Figure 11:
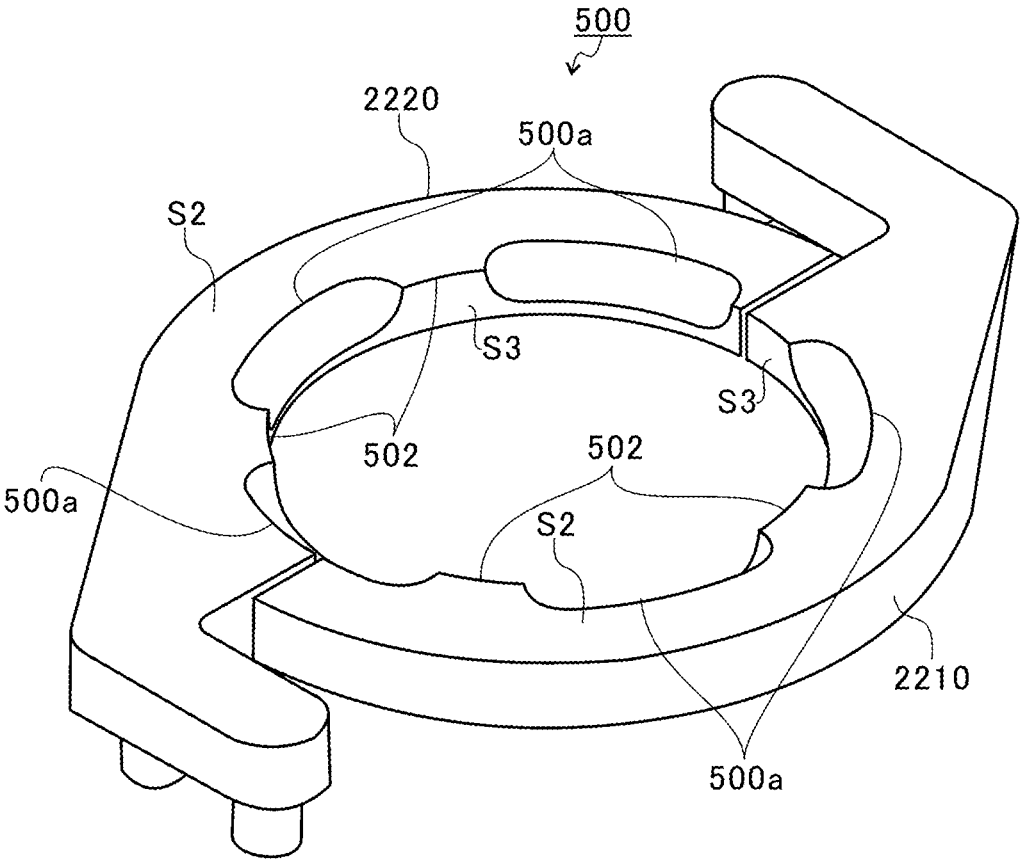
FIG. 11 is a schematic perspective view of movable members according to the third embodiment.

FIG. 11 is a schematic perspective view of movable members 2210 and 2220 according to the third embodiment. Components that are substantially equivalent to those of the centrifugal compressor CC of the above embodiment will be assigned with the same reference signs, and descriptions thereof will be omitted. The movable members 2210 and 2220 of the third embodiment differ from the movable members 210 and 220 of the first embodiment and the movable members 1210 and 1220 of the second embodiment in the shape of the grooves 500.

As shown in FIG. 11, one or more grooves 500 are formed on the movable members 2210 and 2220. The grooves 500 are formed over the inner circumferential surface S3 and the opposing surface S2 in the movable member 2210 and 2220.

The grooves 500 of the third embodiment include a plurality of arc-shaped circumferential grooves 500*a* arranged in the circumferential direction. The plurality of arc-shaped circumferential grooves 500*a* extend in the circumferential direction. The circumferential grooves 500*a* are circumferentially longer than the spherical grooves 300*a* of the first embodiment. Furthermore, the plurality of arc-shaped circumferential grooves 500*a* are spaced apart from each other in the circumferential direction. The plurality of arc-shaped circumferential grooves 500*a* have the same size as each other. However, the plurality of arc-shaped circumferential grooves 500*a* are not limited thereto, and may have different sizes and different shapes from each other.

The plurality of arc-shaped circumferential grooves 500*a* of the third embodiment are formed at equal intervals in the circumferential direction. Protrusions 502 are formed between the plurality of arc-shaped circumferential grooves 500*a*. The protrusions 502 are formed adjacent to the circumferential grooves 500*a* in the circumferential direction. The protrusions 502 partition off the plurality of arc-shaped circumferential grooves 500*a* in the circumferential direction.

In the third embodiment, the example in which the plurality of arc-shaped circumferential grooves 500*a* and protrusions 502 are provided in the movable members 2210 and 2220 is described. However, the movable members 2210 and 2220 may be provided with a single arc-shaped circumferential groove 500*a* and protrusion 502. The movable members 2210 and 2220 may only be provided with at least one circumferential groove 500*a* and protrusion 502. Accordingly, for example, only one arc-shaped circumferential groove 500*a* may be formed in the movable members 2210 and 2220. In this case, the single circumferential groove 500*a* may only be formed on one of the first movable member 2210 and the second movable member 2220, or may be formed over both the first movable member 2210 and the second movable member 2220.

According to the third embodiment, the number of grooves 500 and protrusions 502 formed in the movable members 2210 and 2220 can be adjusted by forming the plurality of circumferential grooves 500*a* spaced apart from each other in the circumferential direction. As the number of collisions between the protrusions 502 and the air flowing backward increases, the pressure loss increases and the compressor efficiency decreases. Therefore, by adjusting the number of protrusions 502, the compressor efficiency can be adjusted.

Fourth Embodiment

Figure 12:
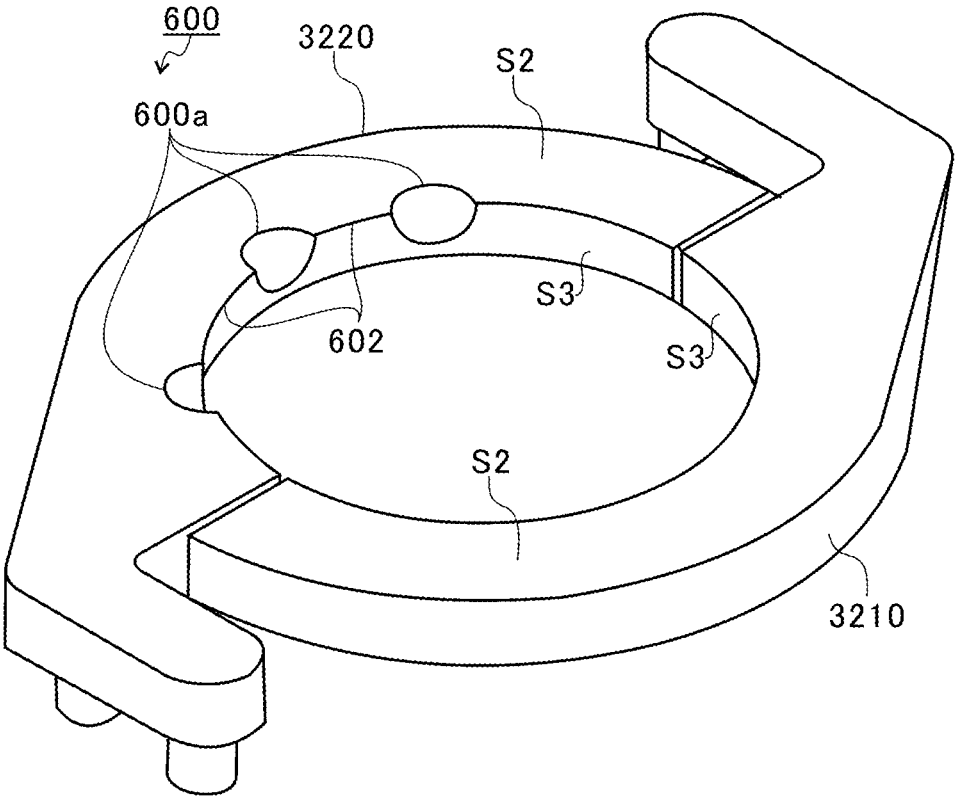
FIG. 12 is a schematic perspective view of movable members according to the fourth embodiment.

FIG. 12 is a schematic perspective view of movable members 3210 and 3220 according to the fourth embodiment. Components that are substantially equivalent to those of the centrifugal compressor CC of the above embodiment will be assigned with the same reference signs, and descriptions thereof will be omitted. The movable members 3210 and 3220 of the fourth embodiment differ from the movable members 210 and 220 of the first embodiment, the movable members 1210 and 1220 of the second embodiment, and the movable members 2210 and 2220 of the third embodiment in the shape of the grooves 600.

As shown in FIG. 12, one or more grooves 600 are formed on the movable members 3210 and 3220. The grooves 600 are formed over the inner circumferential surface S3 and the opposing surface S2 in the movable members 3210 and 3220.

The grooves 600 of the fourth embodiment include a plurality of spherical grooves 600*a* arranged in the circumferential direction. In the fourth embodiment, the plurality of spherical grooves 600*a* are only formed on the second movable member 3220. However, the plurality of spherical grooves 600*a* are not limited thereto, and may be formed only on the first movable member 3210 or on both the first movable member 3210 and the second movable member 3220.

The plurality of spherical grooves 600*a* are spaced apart from each other in the circumferential direction. The plurality of spherical grooves 600*a* have the same size as each other. The plurality of spherical grooves 600*a* have the same size as those of the spherical grooves 300*a* of the first embodiment, for example. However, the plurality of spherical grooves 600*a* are not limited thereto, and may have different sizes from the spherical grooves 300*a* of the first embodiment. Furthermore, the plurality of spherical grooves 600*a* may also have different sizes and different shapes from each other.

The plurality of spherical grooves 600*a* of the fourth embodiment are formed at unequal intervals in the circumferential direction. Protrusions 602 are formed between the plurality of spherical grooves 600*a*. The protrusions 602 are formed adjacent to the grooves 600*a* in the circumferential direction. The protrusions 602 partition off the plurality of spherical grooves 600*a* in the circumferential direction.

In the fourth embodiment, the example in which the plurality of spherical grooves 600*a* and protrusions 602 are provided in the movable members 3210 and 3220 is described. However, the movable members 3210 and 3220 may be provided with a single spherical groove 600*a* and protrusion 602. The movable members 3210 and 3220 may only be provided with at least one groove 600*a* and protrusion 602. Accordingly, for example, only one spherical groove 600*a* may be formed in the movable member 3210 and 3220. In this case, the single groove 600*a* may only be formed on one of the first movable member 3210 and the second movable member 3220, or may be formed over both the first movable member 3210 and the second movable member 3220.

According to the fourth embodiment, by arranging the plurality of grooves 600 at unequal intervals in the circumferential direction, vibration induction of the compressor impeller 9 caused by the collision between the protrusions 602 and the air flowing backward can be reduced.

Although the embodiments of the present disclosure have been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

What is claimed is:

1. A centrifugal compressor comprising:

a housing including an intake flow path;

a compressor impeller arranged in the intake flow path and including a plurality of blades;

an accommodation chamber formed upstream of the blades in a flow of intake air in the housing;

a movable member arranged in the accommodation chamber and movable to a protruding position where the movable member protrudes into the intake flow path and to a retracted position where the movable member is retracted from the intake flow path; and one or more grooves formed over an edge between an inner circumferential surface and a first side face closer to the blades in the movable member, wherein an end of the one or more grooves on the inner circumferential surface in an axial direction of the compressor impeller does not reach a second side face of the movable member opposite to the first side face.

2. The centrifugal compressor according to claim 1, wherein the one or more grooves a plurality of spherical grooves arranged in a circumferential direction of the compressor impeller.

3. The centrifugal compressor according to claim 2, wherein the one or more grooves are formed spaced apart from each other in the circumferential direction.

4. The centrifugal compressor according to claim 3, wherein the one or more grooves are formed at unequal intervals in the circumferential direction.

5. The centrifugal compressor according to claim 2, wherein the one or more grooves are formed at unequal intervals in the circumferential direction.

6. The centrifugal compressor according to claim 1, wherein the one or more grooves include a plurality of arc-shaped circumferential grooves arranged in a circumferential direction of the compressor impeller.

7. The centrifugal compressor according to claim 6, wherein the one or more grooves are formed spaced apart from each other in the circumferential direction.

8. The centrifugal compressor according to claim 7, wherein the one or more grooves are formed at unequal intervals in the circumferential direction.

9. The centrifugal compressor according to claim 6, wherein the one or more grooves are formed at unequal intervals in the circumferential direction.

10. A turbocharger comprising a centrifugal compressor according to claim 1.

11. The centrifugal compressor according to claim 1, wherein the one or more grooves include a plurality of grooves arranged in a circumferential direction of the compressor impeller.

12. The centrifugal compressor according to claim 1, wherein the centrifugal compressor further comprises one or more protrusions formed adjacent to the one or more grooves in a circumferential direction of the compressor impeller.

13. The centrifugal compressor according to claim 1, wherein the movable member includes a first movable member and a second movable member that move relative to each other, and the one or more grooves include a groove formed by a combination of the first movable member and the second movable member.

* * * * *